United States Patent [19]

Ericson

[11] Patent Number: 4,991,623

[45] Date of Patent: Feb. 12, 1991

[54] AUTOMATIC AIR VALVES FOR DUCTS

[76] Inventor: Kurt S. B. Ericson, Prins Boudewijnlaan, 48, Schilde, Belgium

[21] Appl. No.: 441,259

[22] Filed: Nov. 27, 1989

Related U.S. Application Data

[62] Division of Ser. No. 301,547, Jan. 26, 1989, abandoned.

[51] Int. Cl.[5] ..... F16K 17/12; E03C 1/295

[52] U.S. Cl. ..... 137/526; 4/209 FF; 4/211; 137/216.2; 137/217; 137/545; 137/549; 137/550

[58] Field of Search ..... 137/216.2, 217, 526, 137/550, 545, 549; 4/211, 209 FF

[56] References Cited

U.S. PATENT DOCUMENTS

| | | | |
|---|---|---|---|
| 2,028,581 | 1/1936 | Zinkil | 137/217 X |
| 2,096,844 | 10/1937 | Cekal | 137/217 |
| 2,216,808 | 10/1940 | Delany | 137/217 |
| 2,405,241 | 8/1946 | Smith | 137/526 |
| 4,232,706 | 11/1980 | Ericson | 137/216.28 |
| 4,535,807 | 8/1985 | Ericson | 137/526 X |

*Primary Examiner*—Gerald A. Michalsky
*Attorney, Agent, or Firm*—Leonard Bloom

[57] ABSTRACT

An automatic air valve for a conduit, through which passes fluids and/or solids, which valve prevents the discharge of contaminated air therefrom into the environment and which further permits the introduction of fresh air from the environment into the conduit when a negative pressure develops therein. The valves may be disposed at either the terminus of or interposed within the conduit flow line of a duct system. The valves include an interior filter that restrains foreign objects, such as insects and snakes, in the duct systems from operatively interfering with the proper operation of the valve.

2 Claims, 7 Drawing Sheets

AUTOMATIC AIR VALVES FOR DUCTS

CROSS-REFERENCE TO RELATED APPLICATION

The instant application is a divisional application of U.S. patent application No. 301,547 filed Jan. 26, 1989, now abandoned the contents of which are incorporated herein in their entirety.

FIELD OF THE INVENTION

The present invention relates to automatic air valves for ducts through which passes fluids, and/or solids and, in particular, to automatic air valves for sanitation waste pipes which prevent the discharge of contaminated air therefrom and which permit the introduction of fresh air into the ducts when a negative pressure develops therein.

BACKGROUND OF THE INVENTION

Automatic air valves for duct systems which both prevent the discharge of contaminated air therefrom, and allow ambient air to enter the ducts when a negative pressure occurs therein (for example, upon the flushing of a water cabinet of a sanitation system) are well-known. Such automatic air valves have been disclosed in U.S. Pat. Nos. 3,923,081 issued to Persson and 4,232,706 issued to Ericson.

In the automatic valves of which I am aware, the valve members, which control the flow of air in and out of the duct, must be capable of freely moving in response to certain pressures and air movements. Accordingly, these valve members are quite sensitive, being readily subject to being blocked or knocked out of alignment. This blockage or misalignment may interfere with the proper operatio of the valve by, for example, preventing the valve member from being fully opened (unseated) or closed (seated). A major source of such blockage and interference are insects, small animals and other foreign objects, such as debris, which may enter the valve from the ambient enviorment and come into contact with the valve member therein.

To solve the problem of blockage or interference resulting from such foreign objects from the ambient environment, an automatic air valve was disclosed in U.S. Pat. No. 4,535,807 issued to Ericson. In this valve, a grill is disposed over the exterior end of the passageway through which the air passes into the conduit. This grill acts as a filter for preventing and protecting against the entry into the passageway of those foreign objects, thereby preventing them from coming into contact with, or otherwise interfering with, the proper operation of the valve member.

While such an arrangement is extremely useful for preventing the entry of foreign objects from the ambient environment, it offers no protection whatsoever from foreign objects, such as insects, reptiles, small animals or other matter which originate from within the duct system itself. In warmer climates, such as in certain southern portions of the United States, it is common for insects and reptiles (such as snakes) to inhabit such duct systems, especially when the ducts are part of a sanitation system. These foreign objects originating in the duct system can, despite the existence of the grills disclosed in Ericson' 807, still come in contact with, and/or otherwise interfere with the proper operation of the valve member (for example, by preventing the valve member from being fully opened and/or closed), and of the automatic air valve.

Complicating this problem is the fact that sometimes these valves must be interposed directly in the conduit flow line of the duct system. In such cases, the valve must be equipped so that the flow of fluids and/or solids through the conduits of the duct system is not obstructed.

Thus, it can be seen that there remains a need for an automatic air valve for ducts, and in particular for the ducts of a water system or a sanitation system, which provides a means by which foreign objects, such as insects, reptiles, small animals, etc., may be retained in the duct system, so that they are restrained from operatively interfering with the valve member. It can further be seen that there remains a need for such an automatic air valve which is equipped so that fluids and solids may pass therethrough unobstructed, thereby permitting the valve to be interposed directly within the conduit flow line of the duct system.

SUMMARY OF THE INVENTION

Accordingly, it is a primary object of the present invention to provide an automatic air valve for ducts, and in particular for sanitation ducts, through which passes solids and/or fluids, which valve provides a means for retaining in the duct system those foreign objects, such as insects, reptiles, small animals and the like, so that these foreign objects are restrained from interfering with the operation of the valve member.

It is a further object of the present invention to provide a valve that has such a means for restraining foreign objects originating in the duct system from operatively interfering with the operation of the valve member, and which also permits the unobstructed passage of fluids and/or solids through the valve, thereby allowing the valve to be interposed directly within the conduit flow line of the duct system.

In accordance with the teachings of the present invention, there is disclosed an automatic air valve for a duct system having a conduit through which passes fluids and/or solids and which has a pressure therein. This valve includes a tubular member that is connected to the conduit, so that fluids and/or solids pass therebelow in the conduit. A passageway is formed in the tubular member between the conduit and the ambient environment outside the conduit, whereby gaseous communication is provided therebetween. A valve member is disposed in communication with the passageway for automatically controlling the flow of air therethrough. The valve member is operatively movable between a seated closed position and an unseated open position. In the seated closed position, flow of air through the passageway is prevented when the pressure in the conduit is equal to or exceeds the pressure of the ambient environment. In the unseated open position, the flow of air through the passageway is permitted when the pressure in the conduit is less than the pressure of the ambient environment. In this manner, atmospheric air is admitted into the conduit in response to a negative pressure in the conduit. Finally, an interior filter is disposed between the conduit and the valve member, whereby foreign objects in the conduit are restrained from operatively interfering with the valve member.

These and other objects of the present invention will become apparent from a reading of the following specification taken in conjunction with the enclosed drawings.

DESCRIPTION OF PREFERRED EMBODIMENTS

Figure 1:
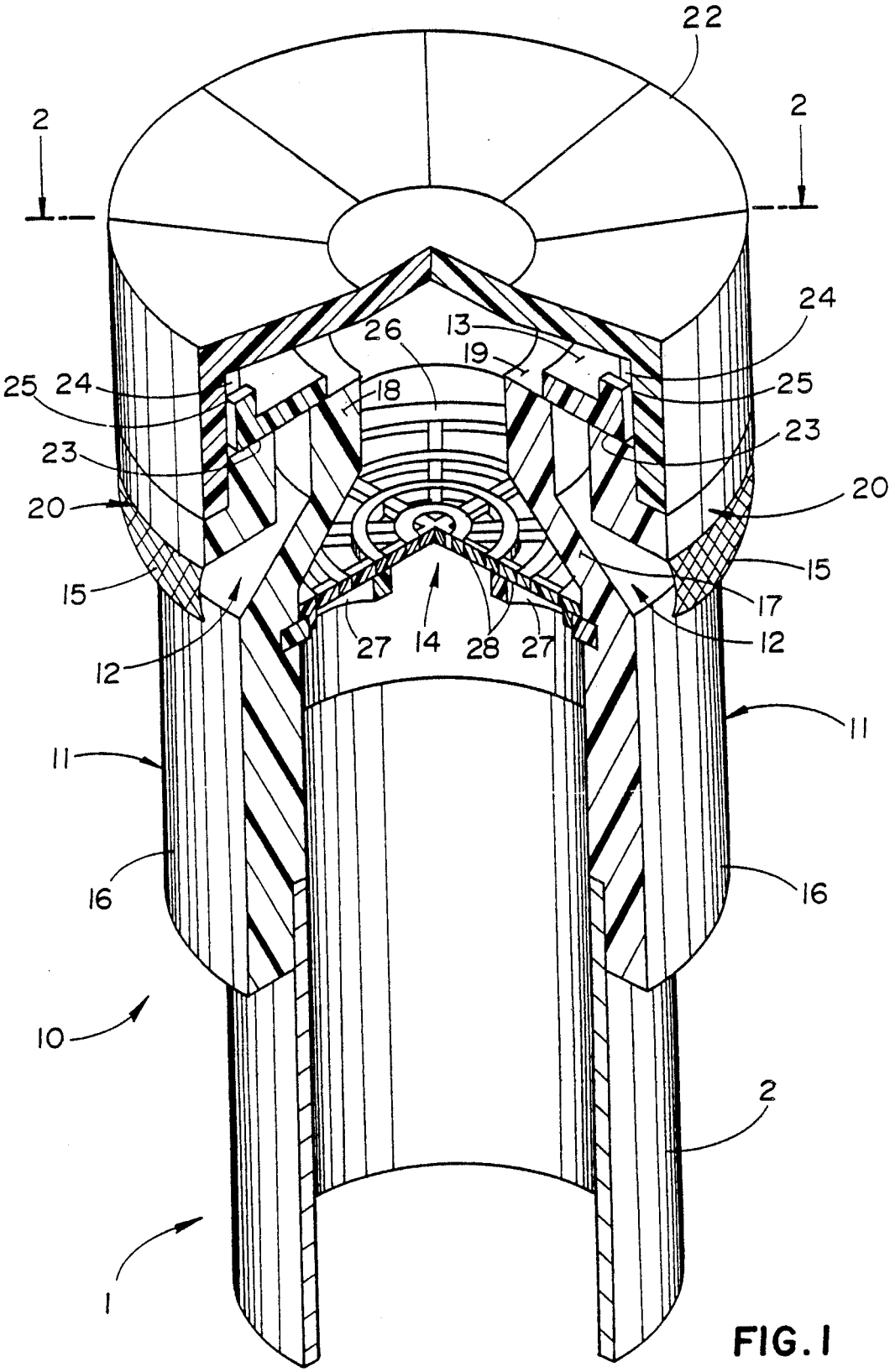
FIG. 1 is a perspective view of a first embodiment of the automatic air valve of the present invention connected to the terminus of a conduit of a duct system, with portions of the valve broken away for the sake of clarity.

The automatic air valve 10 includes a tubular member 11, a passageway 12 and a valve member 13. Of particular interest, the valve 10 also includes an interior filter 14. This interior filter 14 restrains foreign objects, such as snakes and insects, from operatively interfering with the valve member 13. When used in conjunction with an exterior filter 15, this interior filter 14 insures that the valve member 13 is not operatively interfered with by foreign objects.

The air valve 10 may be fitted to duct systems 1 having substantially vertical conduits 2 through which fluids and/or solids pass. These duct systems also have a pressure in the conduits 2 thereof. Examples of such duct systems 1 are water systems and sanitation systems. The valve 10 may be placed either at the terminus of a conduit flow line of the duct system (as at A on FIG. 7) or interposed in the conduit flow line itself (as at B on FIG. 7).

The tubular member 11 is, as shown, preferrably, substantially cylindrical, being in the form of a vertical tube. However, it is to be understood that, while illustrated as being cylindrical in form, the tubular member 11 may, alternatively, be formed having any suitable shape. This member 11 is connected to vertical conduits 2 of the duct system 1 by welding, clamping, or any other suitable means well known to those skilled in the art. Connected thusly, the interior of the tubular member 11 is in communication with the interior of the conduit 2. In this fashion, the creation of a pressure (for example, a negative pressure) in said conduit 2, consequently creates substantially the same pressure in the interior of the tubular member 11 which is in communication with the conduit 2.

Formed in the tubular member 11 is a passageway (an air inlet) 12. This passageway 12 extends between the conduit 2 and the ambient environment outside the conduit 2. In this fashion, gaseous communication is provided between the conduit 2 and the outside ambient environment for admitting air from the ambient environment into the conduit 2. Accordingly, any negative pressure occurring in the conduit 2 relative to the pressure in the ambient environment may be automatically relieved.

Disposed in communication with the passageway 12 is a valve member 13 which rests on a seat, as shall be described at greater length below. The valve member 13 automatically controls the flow of air (and other gases) through the passageway 12. This control is exercised by the valve member 13 being operatively movable between a seated closed position and an unseated open position. When the pressure in the conduit 2 is equal to or exceeds the pressure of the ambient environment the valve member 13 is in the seated closed position, preventing the flow of air through the passageway 12. When the pressure in the conduit 2 is less than the pressure of the ambient environment the valve member 13 is in the unseated open position, permitting the flow of air through the passageway 12. In this manner, the valve automatically admits atmospheric air into the conduit 2 in response to a negative pressure in the conduit 2. Furthermore, the valve prevents pollution of the ambient atmosphere by retaining polluted air (such as methanol and ethanol) present in the duct system (especially in the ducts of a sewage system) from escaping into the ambient environment.

If desired, at, or over, the exterior end (the air inlet end) of the passageway 12, an exterior filter 15 is disposed, so as to be positioned and maintained between the ambient environment and the valve member 13. Preferrably, this exterior filter 15 is in the form of a netting or a grill which may be fabricated from any suitable material. The exterior filter 15 is disposed across the exterior end of the passageway 12. Disposed thusly, the exterior filter 15 is maintained substantially against (or secured to) the valve 10 by any suitable means, so as to prevent foreign objects, such as insects, small animals, etc., from entering the passageway 12.

Finally, an interior filter 14 is provided. This interior filter 14 is disposed between the conduit 2 and the valve member 13, being maintained (or secured) in place by any suitable means. If desired, the filter 14 may, in general, be molded as part of the body of the valve 10. The interior filter 14 retains foreign objects within the conduit 2. In this fashion, these foreign objects, such as insects and reptiles are restrained from operatively interfering with the valve member 13. In this respect, the breeding areas of insects (such as mosquitos and cockroaches) that can carry contagious diseases are kept inside the duct system by the interference filter 14.

Figure 2:
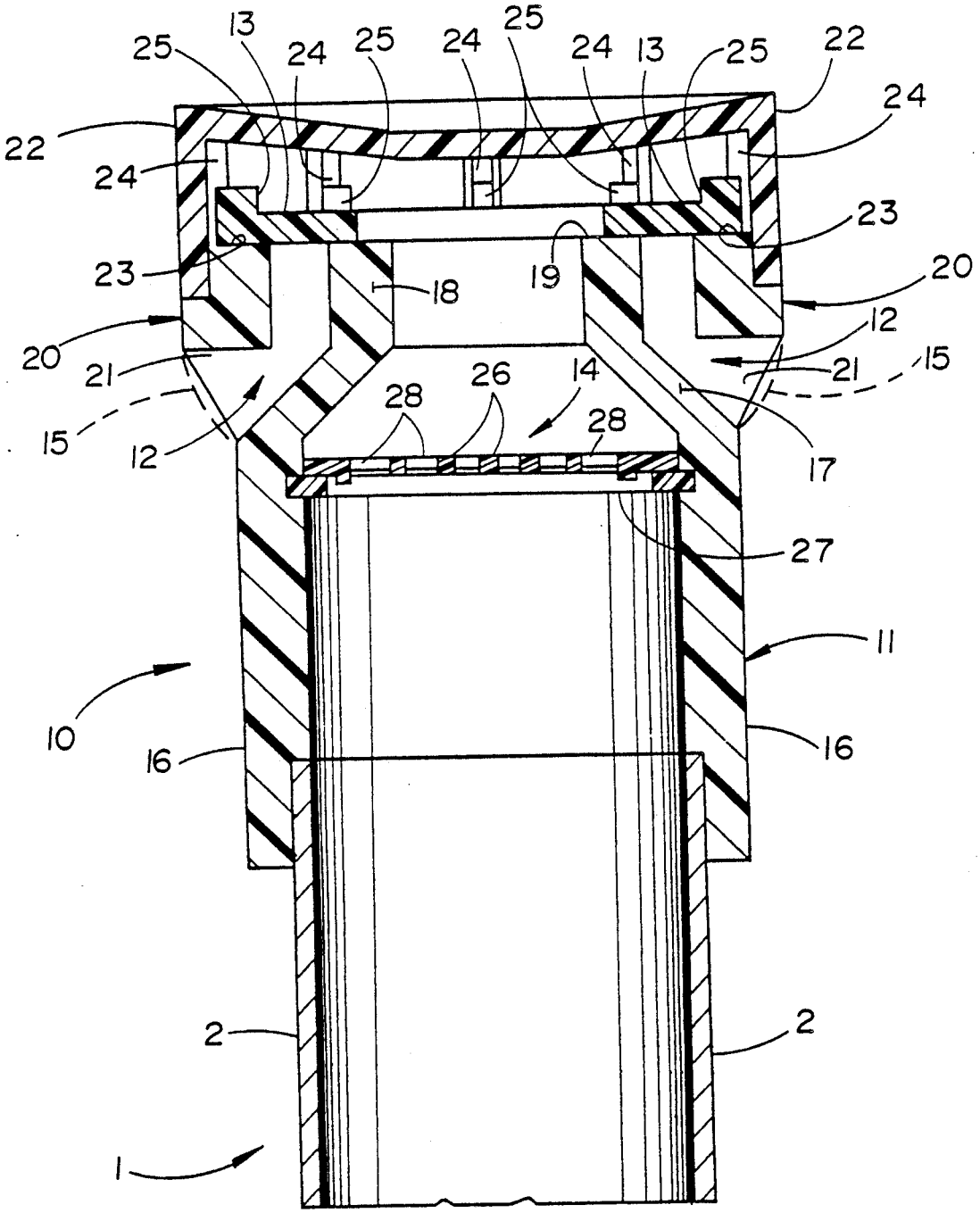
FIG. 2 is a cross-section view taken along lines 2—2 of FIG. 1.
Figure 3:
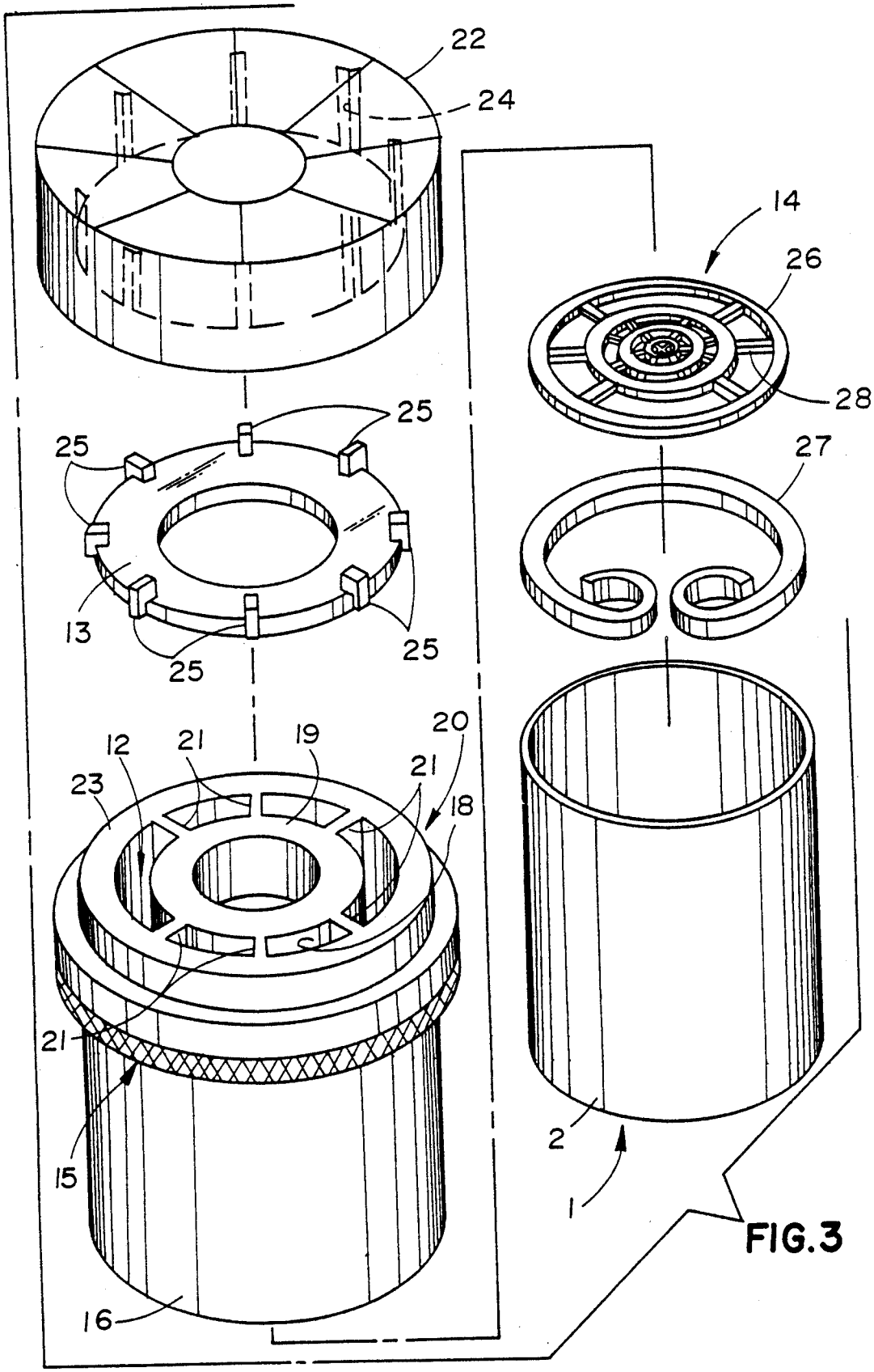
FIG. 3 is an exploded perspective view of the automatic air valve of FIG. 1.

Referring in particular now to FIGS. 1-3, the valve 10 includes the vertical tubular member 11 connected (disposed) at the terminus of one of the conduits 2 of the duct system 1.

The tubular member 11 has a lower section 16, which is connected to the conduit 2, and an upper section 17. The upper section 17 is reduced in cross-section (diameter) relative to the lower section 16. This reduction in cross-section is provided by a frustro-conical constriction in the form of a venturi having a neck 18 terminating in a first lip 19.

Disposed annularly about the neck 18 is an annular support ring 20. Support ring 20 is spaced from the neck 18, so that the passageway 12 (the interior end of the passageway 12) may pass therebetween. This support ring 20 is, preferrably, integral with the neck 18 (and the remainder of the tubular member 11) by a plurality of crosspieces 21 which are joined to, and extend between, the exterior of the upper section 17 of the tubular member 11 and the support ring 20.

A spaced cover 22 is received on and supported by the support ring 20, so that said cover 20 overlies, and cooperates with, the upper section (the top end) 17 of the tubular member 11, so as to form in the upper section 17, the peripheral or annular passageway (flow passage) 12. This passageway 12 is in the shape of duct having an interior end that is in communication with the interior of the conduit 2. The cover 22 may be either integral with, or separable from, the support ring 20, as desired. Alternatively, the cover 22 may be formed, so that a plurality (at least one) of passageways 12 are formed therein and not just one peripherally or annularly continuous passageway 12.

Formed on the inner periphery of the support ring 20 is a second lip 23. Lip 23 is oriented towards and cooperates with the lip 19 to form a valve seat at the exterior of the neck 18 where the interior end of the passageway 12 is located. Valve member 13 operatively rests on this valve seat during various operations of the valve 10.

It will be seen that if a negative pressure occurs in the vertical conduit 2, for example as a result of draining, flushing, emptying or other operation, the valve member 13 will be lifted from the valve seat formed by the lips 19 and 23 and into the unseated, open position. In this postion, fresh air from the ambient environment can pass through the passageway 12 and into the conduit 2, equalizing the pressure in the conduit 2 with that of the ambient environment. Conversely, if the pressure in the vertical conduit 2 is equal to, to greater than the pressure (overpressure) in the conduit 2, the valve member 13 will be lowered (seated) onto the valve seat formed by lips 19 and 23 and into the seated closed position. In this position, the valve member 13 shuts off or seals the passageway 12, so that contaminated air in the conduit 2 is preventing from escaping therefrom into the ambient environment.

Because the diameter of the passageway 12 at the interior end is smaller than the diameter of the conduit 2, an increase in capacity of the valve 10 is obtained, which renders possible the use of the valve 10 in buildings having a large number of stores.

The valve 10 of the present invention may utilize whatever appropriate means desired for permitting the valve member 13 to vertically, operatively move. Preferrably, the means utilized includes the interior of the cover 22 having a plurality of grooves 24 formed therein. Each groove 24 cooperates with a respective rib molded on respective upwardly-extending guide lugs 25 formed on the valve member 13. Each of the ribs of lugs 25 are received in a respective groove 24, thereby providing a guide means for permitting the valve member 13 to vertically, operatively move. However, it is expressly understood that, alternatively, this means may include either inclining the inner wall of the cover 22, such as is described in U.S. Pat. No. 4,232,706, or providing the external guides disclosed in U.S. Pat. No. 4,535,807, or any other suitable means. Such means insures that the valve member 13 does not become jammed in an oblique or horizontal position, in which the valve member 13 might stay in the open (unseated) position when the pressure has been balanced.

The interior filter 14 is disposed in the tubular member 11 between the conduit 2 and the valve member 13. This filter 14 acts to retain foreign objects in the conduit 2, restraining said foreign objects from contacting and/or operatively interfering with the valve member 13.

The interior filter 14 preferrably includes a plurality of substantially concentric rings 26. Rings 26 are disposed across the inside of the upper section 17 of the tubular member 11 being supported therein by any suitable means (support members), such as circlips 27 that are received and supported in an annular groove that is formed about the interior of said member 11. These rings 26 permit gasses (such as air) to pass freely therethrough while foreign objects are retained in the conduit 2 being restrained from operatively interfering with the valve member 13. It is noted here that the support members 27 may be formed and/or positioned as desired in the interior of the member 11, so that the filter 14 may be positioned where desired.

Finally, at least one, and preferrably a plurality, of support arms 28 are, preferrably, positioned extending substantially diametrically across, the rings 26 of the filter 14 being supported on, the interior support member 27. Said support arms 28 have the concentric rings 26 disposed thereon and secured thereto. In this fashion, the concentric rings 26 are supported on the arms 28. Preferrably, the arms 28 intersect one another at a common midpoint where they may be joined by welding, bolting or any other suitable means. Such joining lends the filter 14 additional structural rigidity and strength for restraing the solids in question.

It is to be noted herein that, while described above as rings 26 having various support arms 28, it is to be expressly understood that, like the tubular member 11, the precise shape and structure of the interior filter 14 may be varied as desired or needed, so as to be in any suitable shape which extends across the inside of the tubular member 11. In this respect, the concentric rings 26 and the support arms 28, while preferred, are not mandatory and that any suitable structure or shape may be employed. However, it is noted that, in any case, the interior filter 14 should be either sufficiently rigid, so that it cannot be deformed by foreign objects in the conduit 2, or be sufficiently secured in place (to either the circlips 27, the tubular member 11 and/or otherwise), so that foreign objects will not be able to dislodge or otherwise move it.

Figure 4:
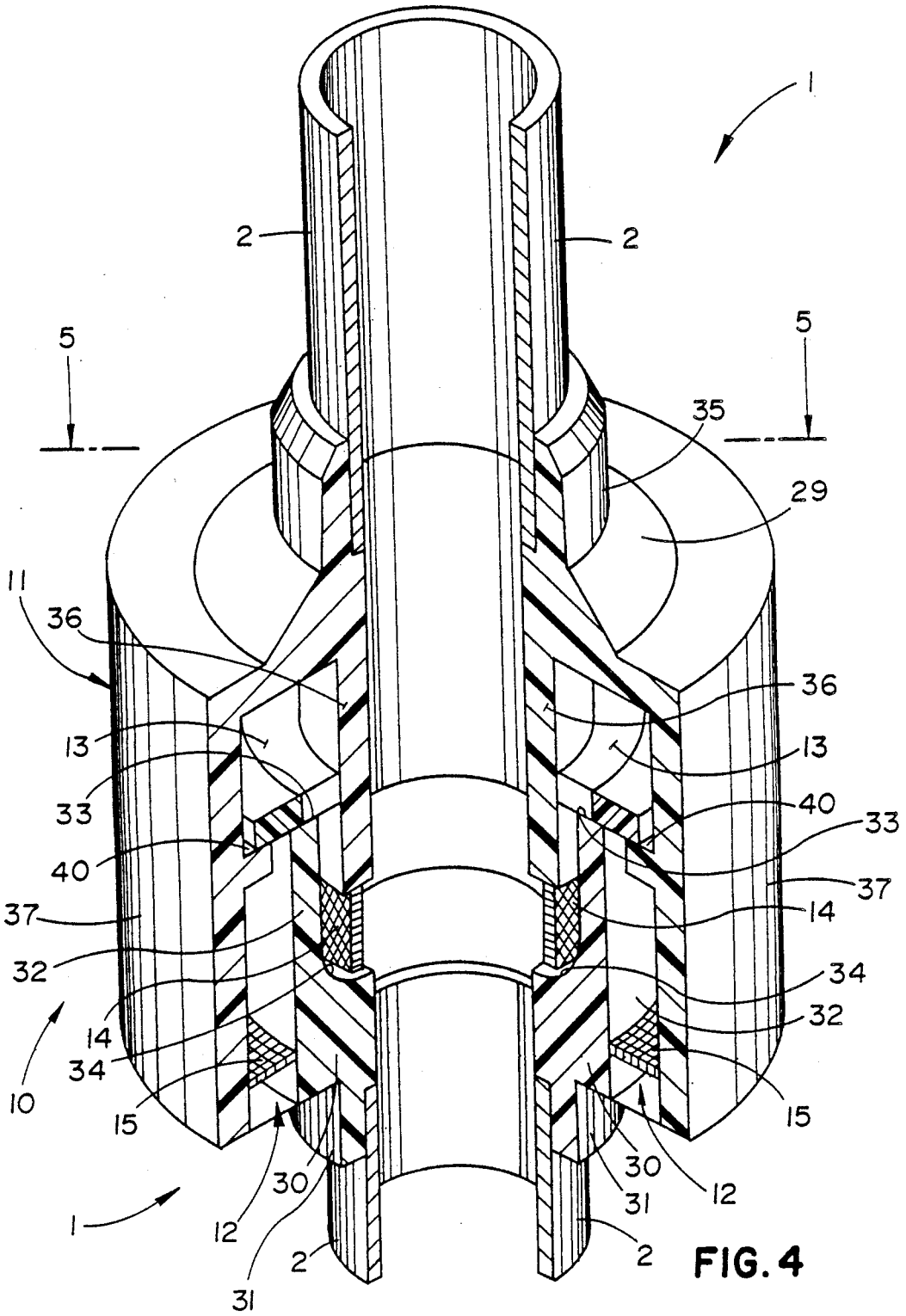
FIG. 4 is a perspective view of a second embodiment of the automatic air valve of the present invention interposed in the conduit flow line of a duct system, with portions of the valve broken away for the sake of clarity.
Figure 5:
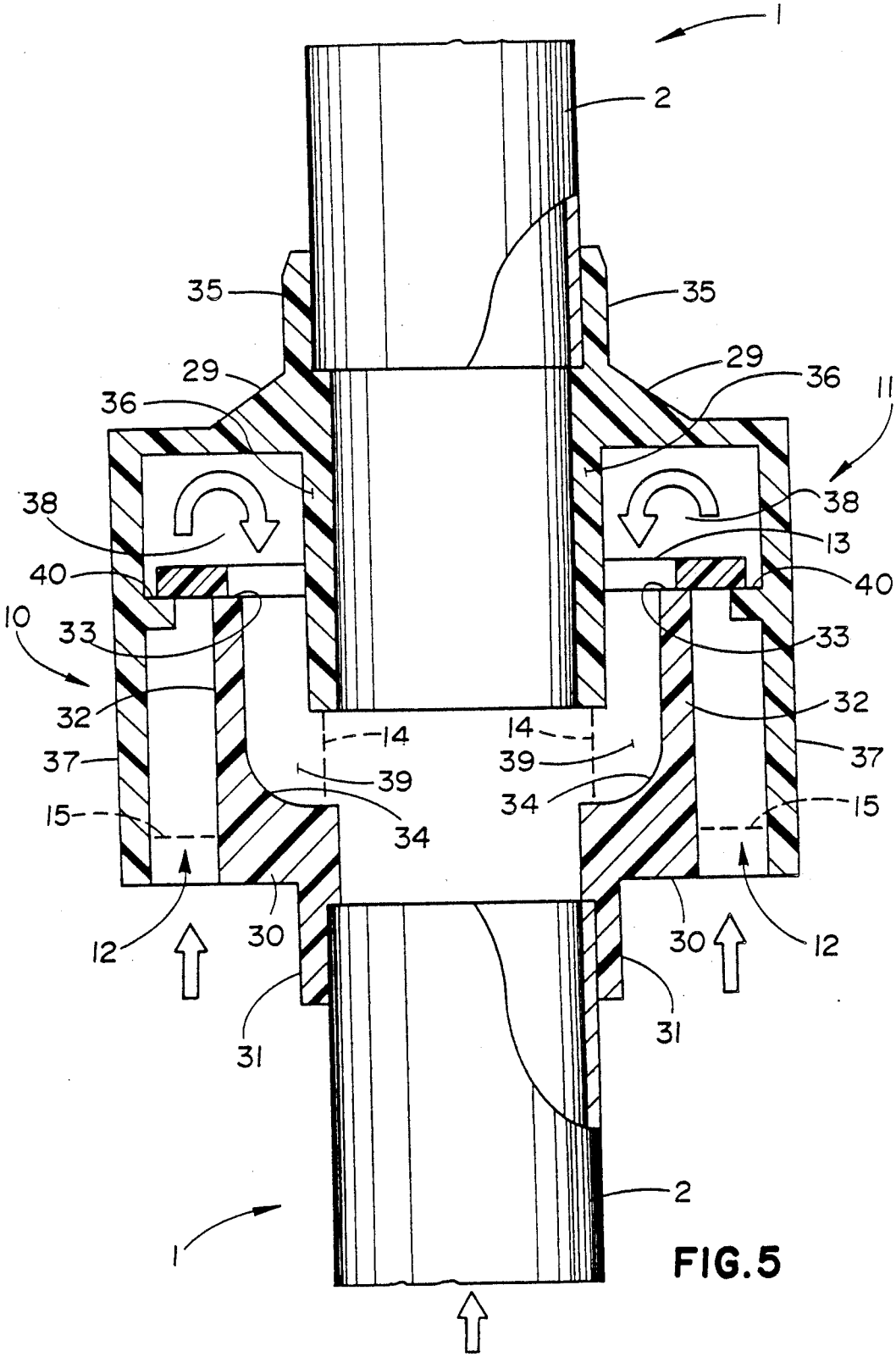
FIG. 5 is a cross-section view taken along lines 5—5 of FIG. 4.
Figure 6:
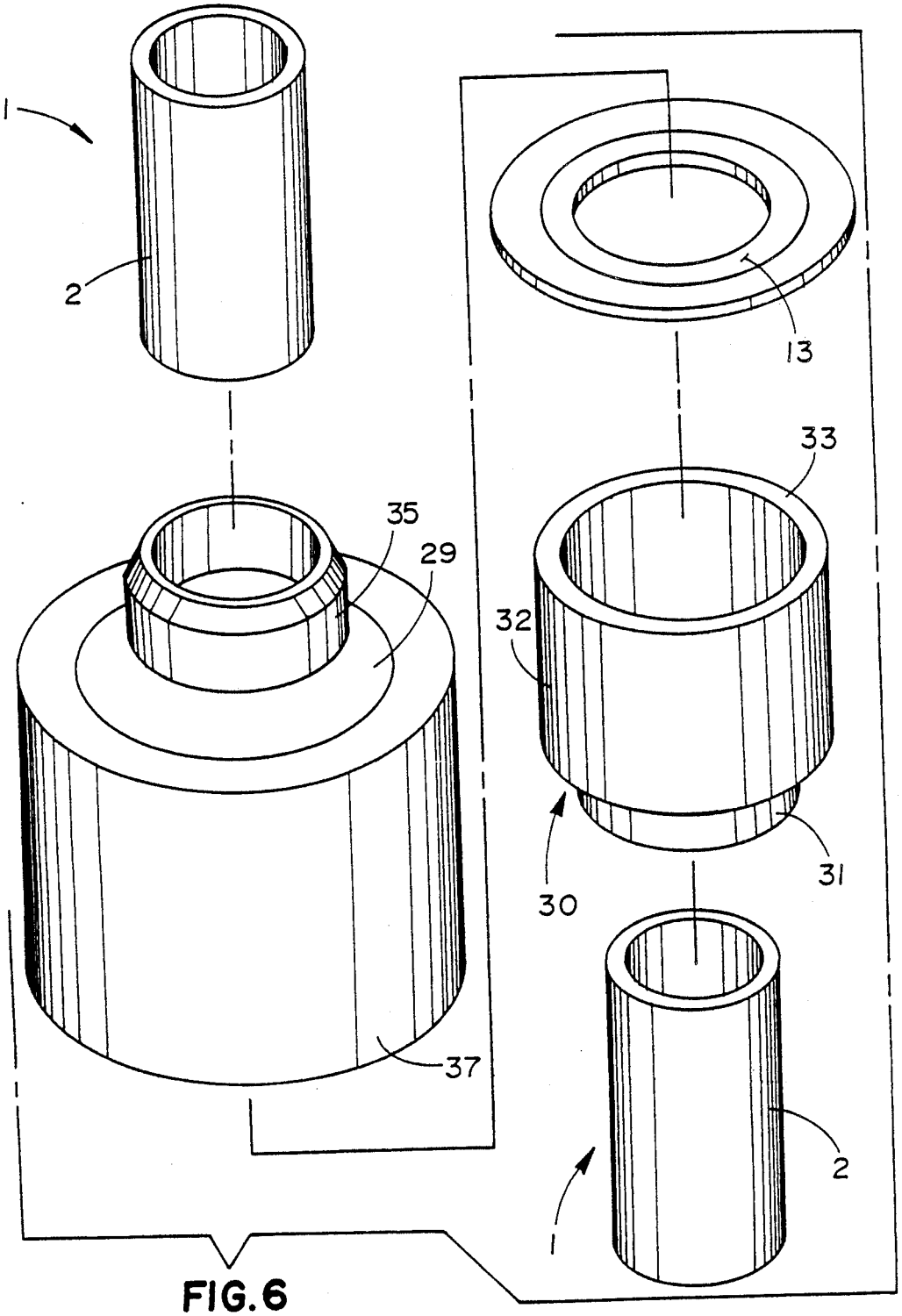
FIG. 6 is an exploded perspective view of the automatic air valve of FIG. 4.

Referring now to FIGS. 4–6, the tubular member 11 of the valve 10 is adapted to be connected at both ends thereof, so as to be interposed directly in the conduit flow line of the duct system 1. Accordingly, the tubular member 11 must be adapted, so that fluids, solids and/or foreign objects may freely pass therethrough. As such, the valve 10, the interior filter 14 and the interior support members 27 thereof, described relative to FIGS. 1–3 would not be suitable for use in such an arrangement because it would interfere with this free flow.

The tubular member 11 may be fabricated as a single integral unit. However, it is preferred to form the member 11 as a two-piece unit having an upper portion 29 and a lower portion 30 that "mate" with one another.

The lower portion 30 of the tubular member 11 includes a downwardly-extending annular flange 31 that is received on and secured to the conduit 2 therebelow by any suitable means. Above the flange 31, the lower portion 30 has a wall 32 that is offset outwardly from the flange 31 and which extends annularly about the flange 31 and upwardly therefrom, terminating in a first lip 33. It is noted that the lower end of the side of the wall 32 which faces the conduit 2 is inwardly curved, so as to form a rounded curved bend 34 therein. Preferrably, this bend 34 is, at least, a substantially 90° bend.

The upper portion 29 of the tubular member 11 includes an upwardly-extending annular flange 35 that is received on and secured to the conduit 2 thereabove by any suitable means. Below the flange 35, the upper portion 29 has an annular inner wall 36 that extends substantially vertically downwardly from the flange 35. The upper portion 29 further has an annular outer wall 37 that is spaced from the inner wall 36 and is offset outwardly from the flange 35, extending downwardly therefrom. Positioned thusly, the wall 32 of the lower portion 30 lies between (preferrably substantially equidistantly between), and is spaced from, both the inner wall 36 and the outer wall 37 of the upper portion 29. In this fashion, the peripheral or annular passageway (flow passage) 12 is formed through the tubular member 11 in the form of a duct having an interior end, which is in direct communication with the interior of the conduit and the conduit flow line, and an exterior end that is in communication with the ambient environment.

As seen, the presence of the wall 32 of the lower portion 30 in between walls 36 and 37 forms a passageway 12 having a substantially 180° bend 38 formed therein. Also, the wall 36 and the curved portion 34 of the wall 32 cooperate to form a second substantially 90° bend 39 in that portion of the passageway 12 that lies between the valve member 13 and the interior end of the passageway 12. In this fashion, the interior end of the passageway 12 is oriented at a substantially 90° angle to the flow of fluids, solids and/or foreign objects through the tubular member 11. If desired, the lower end of the wall 32 may be curved inwardly, forming a rounded bend therein that is between 90° and 180°, so that the second bend 39 is between 90° and 180°. In this fashion, the interior end of the passageway 12 may be oriented downwardly towards the conduit 2 therebelow.

Formed on the inner periphery of the upper portion 29 (on wall 37) is a second lip 40. Lip 40 is oriented towards and cooperates with lip 33 to form a valve seat in the passageway 12 substantially at the 180° bend 38 that is formed therein. It is to be noted that, if desired, wall 37 may be formed such that it extends downwardly, terminating coincidentially with the lip 40 formed thereon.

Once again, it will be seen that if a negative pressure occurs in the vertical conduit 2, for example as a result of draining, flushing, emptying or other operation, the valve member 13 will be lifted from the valve seat formed by the lips 33 and 40 and into the unseated, open position. In this position, fresh air from the ambient environment can pass through the passageway 12 and into the conduit 2, equalizing the pressure in the conduit 2 with that of the ambient environment. Conversely, if the pressure in the vertical conduit 2 is equal to or greater than the pressure in the conduit 2 (an overpressure), the valve member 13 will be lowered (seated) onto the valve seat formed by lips 33 and 40 and into the seated closed position. In this position, the valve member 13 shuts off or seals the passageway 12, so that contaminated air in the conduit 2 is preventing from escaping therefrom into the ambient environment.

If desired, the diameter of the interior end of the passageway 12 may be adjusted as desired to either provide or discourage a venturi effect. In any event, due to the diameter of the passageway 12 at the interior end being smaller than the diameter of the conduit 2, an increase in the capacity of the valve is obtained which renders possible the use of the valve 10 in buildings having a greater use of stores.

Once again, any appropiate means may be employed for providing a means by which the annular valve member 13 may vertically, operatively move, as described at length above.

The interior filter 14 is disposed in the tubular member 11 between the conduit 2 and the valve member 13. Thus, in the valve shown in FIGS. 4–6, this filter 14 may be situated at any position or level in the portion of the passageway 12 that is formed between the walls 32 and 36. Preferrably, the interior filter 14 is disposed in the passageway 12, extending thereacross and being secured to the tubular member 11 or otherwise maintained in place. Alternatively, it may be disposed over the entrance to the interior end of the passageway 12, being secured to the tubular member 11 or otherwise maintained in place. This filter 14 acts to retain foreign objects in the conduit 2, restraining said foreign objects from contacting and/or operatively interfering with the valve member 13.

It is contemplated herein that the interior filter 14 will be in the form of a grill fabricated from a plastic or any other suitable material.

A significant advantage for the valve 10 described above relative to FIGS. 4–6 is that the interior of the tubular member 11 remains entirely free of filters or other elements, so that it can be fitted to a device, such as a siphon, or so that it can be interposed in the conduit flow line of a duct system.

Figure 7:
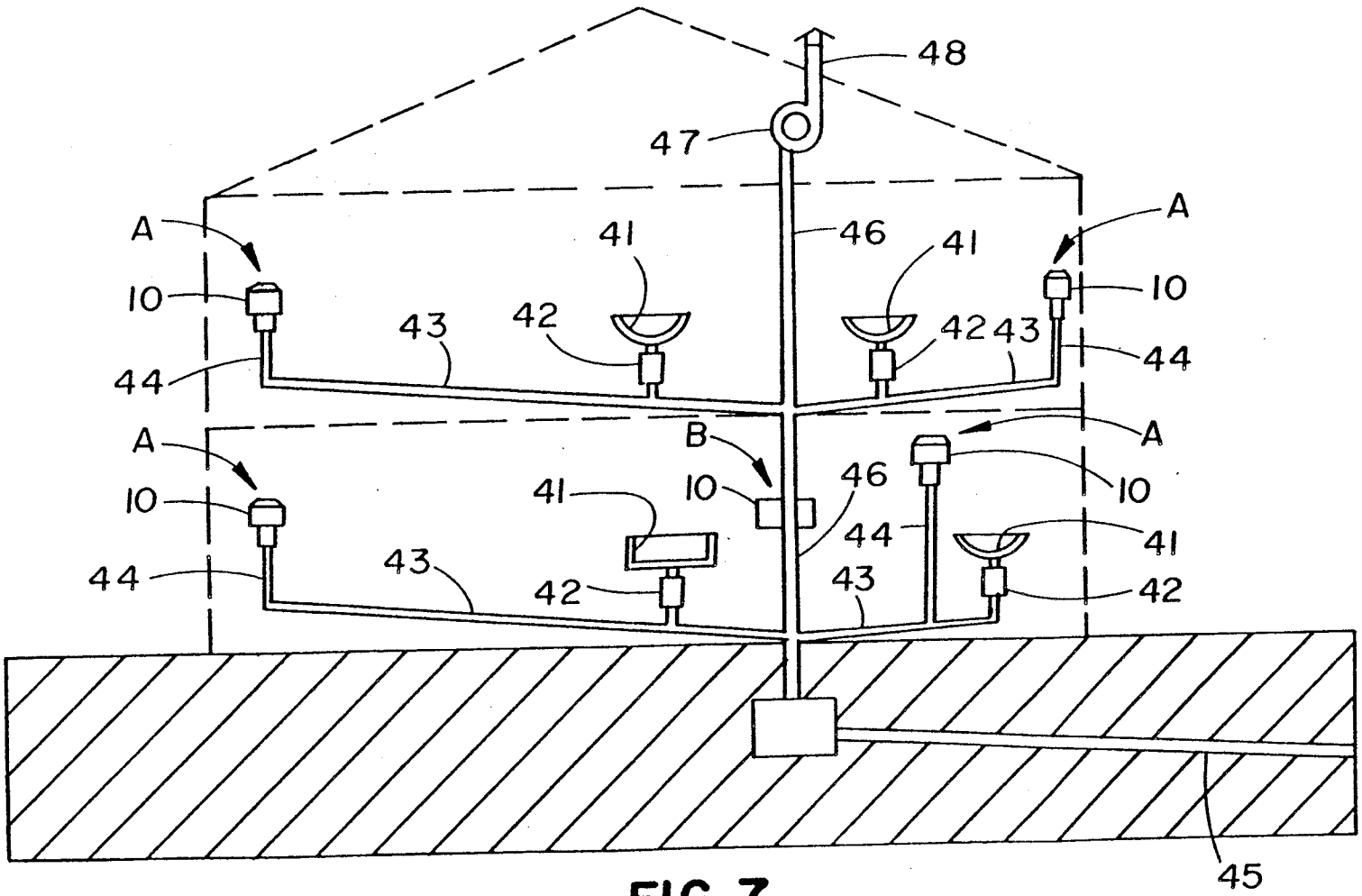
FIG. 7 illustrates the application of the automatic air valves of FIGS. 1-3 and 4-6.

With reference now to FIG. 7, the location of installation of the valves 10 in a duct system 1 of an ordinary house which is used for the discharge of waste water is illustrated. The devices 41 used to discharge water (such as a lavatory, a basin, sinks, etc.) are provided with respective traps or siphons 42. Each trap or siphon 42 is, in turn, connected a substantially horizontal inclined conduit 43. Also, if desired, substantially vertical valve conduits 44 may be connected to respective inclined conduits 43. These valve conduits 44 are positioned substantially at the terminus of respective conduit flow lines of the duct system.

Each of the inclined conduits 43 is, in turn, connected to a main waste conduit 45 via a substantially vertical main venting conduit 46 having a fan 47. Fan 47 includes an outlet 48 for delivery to the atmosphere. When this fan 46 is in operation, it produces a negative pressure in the conduits 43, 44 and 46 lifting the different valve members 13 of the different valves 10. In this way, stale air can thereby be discharged from the duct system via conduit 46 at outlet 48.

Automatic valves 10 of the type discussed with reference to FIGS. 1–3 are disposed at the terminus of the conduit flow line (on the valve conduits 44) as at A. Automatic valves 10 of the type discussed with reference to FIGS. 4–6 are interposed in the conduit flow line (in the main venting conduit 46) as at B.

Obviously, many modifications may be made without departing from the basic spirit of the present invention. For example, if desired, the precise shapes of the passageway 12 and the precise positioning of the valve members 13 may be varied somewhat and other elements, such as insulation as is described in U.S. Pat. No. 4,232,706, may be provided surrounding the valves 10. Accordingly, it will be appreciated by those skilled in the art that, within the scope of the appended claims, the invention may be practiced other than has been specifically described herein.

What is claimed is:

1. An automatic air valve for a duct system having a conduit through which passes fluids and/or solids, the conduit further having a pressure therein, said air valve, in combination, comprised of:

a tubular member interposed in the conduit of the duct system, such that the fluids and/or solids may freely pass through both the tubular member of the valve and the conduit of the duct system;

a passageway formed in the tubular member between the conduit and the ambient environment outside the conduit, whereby gaseous communication is provided therebetween;

the passageway having an interior end and an exterior end, the passageway further having a substantially 180° bend formed therein between the interior and exterior ends thereof and a second substantially 90° bend formed therein between the 180° bend and the interior end of the passageway;

a valve member disposed in the substantially 180° bend of the passageway for automatically controlling the flow of air therethrough, said valve member being operatively movable between a seated closed position, wherein the flow of air through the passageway is prevented when the pressure in the conduit is equal to or exceeds the pressure of the ambient environment, and an unseated open position, wherein the flow of air through the passageway is permitted when the pressure in the conduit is less than the pressure of the ambient environment for admitting atmospheric air into the conduit in response to a negative pressure in the conduit;

an interior filter disposed between the conduit and the valve member, whereby foreign objects in the conduit are restrained from operatively interfering with the valve member; and the interior filter being disposed substantially at the interior end of the passageway between the conduit and the valve member, whereby foreign objects in the conduit are restrained from operatively interfering with the valve member.

2. The automatic air valve of claim 1, further comprised of:

the passageway extends substantially peripherally about the tubular member; and the interior filter includes a grill that is secured to the tubular member substantially extending across the interior end of the passageway between the conduit and the valve member, whereby foreign objects from the conduit are restrained from operatively interfering with the valve member.

* * * * *